United States Patent [19]

Diehl et al.

[11] Patent Number: 4,486,331

[45] Date of Patent: Dec. 4, 1984

[54] AQUEOUS STABLE SUSPENSION OF WATER INSOLUBLE SILICATE CAPABLE OF BINDING CALCIUM IONS AND ITS USE FOR THE PRODUCTION OF WASHING AND CLEANSING AGENTS

[75] Inventors: Manfred Diehl, Frankfurt am Main; Roland Bergmann, Hanau; Günter Stadtmüller, Alzenau, all of Fed. Rep. of Germany

[73] Assignee: Degussa Aktiengesellschaft, Frankfurt, Fed. Rep. of Germany

[21] Appl. No.: 475,394

[22] Filed: Mar. 15, 1983

[30] Foreign Application Priority Data

Mar. 17, 1982 [DE] Fed. Rep. of Germany ..... 3209631

[51] Int. Cl.[3] ..... C11D 1/66; C11D 1/72

[52] U.S. Cl. ..... 252/174.25; 252/174.21; 252/174.22; 252/173; 252/181; 252/DIG. 2; 252/DIG. 14

[58] Field of Search ..... 252/174.21, 174.22, 252/174.25, 173, 179, 181, DIG. 14, DIG. 2

[56] References Cited

U.S. PATENT DOCUMENTS

| | | | |
|---|---|---|---|
| 4,083,793 | 4/1978 | Jakobi et al. | 252/99 |
| 4,169,075 | 9/1979 | Kuhling et al. | 252/558 |
| 4,179,393 | 12/1979 | Andree et al. | 252/155 |
| 4,280,920 | 7/1981 | Garvey et al. | 252/173 |
| 4,409,136 | 10/1983 | Cheng | 252/540 |

FOREIGN PATENT DOCUMENTS

| | | |
|---|---|---|
| 2544605 | 4/1976 | Fed. Rep. of Germany . |
| 2856087 | 7/1980 | Fed. Rep. of Germany . |

*Primary Examiner*—Paul Lieberman

*Attorney, Agent, or Firm*—Cushman, Darby & Cushman

[57] ABSTRACT

There are provided aqueous pumpable stable suspensions of a water insoluble silicate capable of binding calcium ions which contain based on the total weight of the aqueous suspension (A) as the silicate capable of binding calcium 0.5 to 80 weight percent of a finely divided, bound water containing, synthetically produced, water insoluble compound of the general formula $$(Cat_{2/n}O)_x \cdot Me_2O_3 \cdot (SiO_2)_y \quad \text{(I)},$$

in which Cat is a cation exchangeable with calcium and which has the valence n, x is a number from 0.7 to 1.5, Me is boron or aluminum and y is a number between 0.8 and 6 and (B) as a dispersingly active component 0.5 to 6 weight percent of a mixture of at least two different alkylphenolethoxylates of the formula

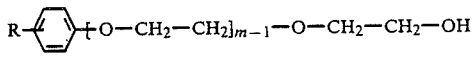

(II)

where R is an alkyl group of 1 to 15 carbon atoms. The component A especially can be a zeolite A while component B can consist of two alkylphenolethoxylates of formula (II) in which m is 2 to 7 and m is 8 to 15. The suspension can be employed for the production of powdery washing agents and detergents.

22 Claims, No Drawings

AQUEOUS STABLE SUSPENSION OF WATER INSOLUBLE SILICATE CAPABLE OF BINDING CALCIUM IONS AND ITS USE FOR THE PRODUCTION OF WASHING AND CLEANSING AGENTS

BACKGROUND OF THE INVENTION

There has already been proposed a process for washing and cleaning solids materials, especially textiles as well as suitable washing agents and detergents for carrying out the process wherein the role of phosphates as calcium complex binders has been entirely or partially replaced by finely divided, generally bound water containing water insoluble aluminum silicates which are capable of binding calcium (see German OS 2412837).

Thereby it is a matter of compounds of the general formula (I)

$$(Cat_{2/n}O)_x.Me_2O_3.(SiO_2)_y \quad (I),$$

in which Cat is a cation exchangeable with calcium and which has the valence n, x is a number from 0.7 to 1.5, Me is aluminum and y is a number from 0.8 to 6, preferably from 1.3 to 4.

Sodium is the preferred cation, but it can also be replaced by lithium, potassium, ammonium or magnesium.

The above defined compounds capable of binding calcium for simplicity are designated below as "aluminum silicates". This is especially true also for the preferably used sodium aluminum silicate; all of the statements made for the use according to the invention and the collective statements in regard to the production and properties accordingly are true for all of the above described.

The particularly suitable aluminum silicates for use in washing agents and detergents has a calcium binding power of preferably 50 to 200 mg CaO/g of the water free aluminum silicate. When reference is made below to water free aluminum silicate thus there is meant the condition of the aluminum silicate which is reached after drying for one hour at 800° C. In this drying the adhering and the bound water are practically completely removed.

In the production of washing agents or detergents in which in addition to the customary components present in this type of agent there is also present the above defined aluminum silicate, advantageously there is started with aluminum silicates which are wet, for example from their production. Thereby the wet compounds are mixed with at least a part of the remaining components of the agent being produced and the mixture converted by known procedurs, as for example spray drying into the finished washing agent or detergent (cleaning agent) as end product, for example into a product capable of being poured.

In the framework of the precedingly sketeched process of producing washing agents or detergents the aluminum silicate is supplied or employed for example as an aqueous suspension. Thereby there is still desired certain improvements of the suspension properties, e.g. the suspension stability and the pumpability, of the aluminum silicate dispersed in the aqueous phase.

It is known to use alkylphenol ethylene oxide adducts for the formation of aluminum silicate suspensions. Preferred are adducts with 6 to 7 moles of ethylene oxide (German OS 2615698).

SUMMARY OF THE INVENTION

It has now been found that specific mixtures of alkylphenolethoxylates to a particularly special degree have the capability to stabilize suspensions of the above type of calcium binding aluminum silicates so that these are stable for a long time even at high solids content and even after standing for a long time can be pumped without problem. It has been shown surprisingly that these specific mixtures are able to hold sedimentation stable over a long time without stirring even moist aluminum silicates, which have a water content of 70% and less.

The subject matter of the invention is aqueous pumpable, stable suspensions of a water insoluble silicate capable of binding calcium ions which contain based on the total weight of the aqueous suspension (A) as the silicate capable of binding calcium 0.5 to 80 weight percent of a finely divided, bound water containing, synthetically produced, water insoluble compound of the general formula $$(Cat_{2/n}O)_x.Me_2O_3.(SiO_2)_y \quad (I),$$

in which Cat is a cation exchangeable with calcium and which has the valence n, x is a number from 0.7 to 1.5, Me is boron or aluminum and y is a number between 0.8 and 6 and (B) is a dispersingly active component 0.5 to 6 weight percent, preferably 1 to 2 weight %, especially 1.4 to 1.6 weight % of a mixture of at least two different alkylphenolethoxylates of the formula

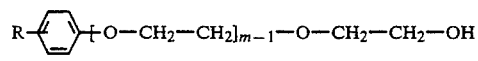

$$R-C_6H_4-[O-CH_2-CH_2]_{m-1}-O-CH_2-CH_2-OH \quad (II)$$

where R is an alkyl group of 1 to 15 carbon atoms. For example in Formula (II) R can be methyl, ethyl, propyl, butyl, pentyl, hexyl, heptyl, octyl, nonyl, decyl, dodecyl or pentadecyl and preferably has 9 carbon atoms as in nonyl. The group R can be substituted in the ortho, meta and/or para position. Thus there can also be employed mixtures in which besides the p-substituted aryl ring there is also present an o-substituted benzene ring. Preferably there are employed mixtures in which there is present up to 90% of a p-substitution and down to 10% of an ortho substitution.

m in one of the mixture of alkylphenolethoxylates used can be 2 to 7, preferably 4 to 6, especially 5 and in the other alkylphenolethoxylate m is 8 to 15, preferably 8 to 12, especially 9 or 10. However, m can also be a mixture of alkylphenolates in which mis 7 or 9 or 12.

The component A can be crystalline in the suspension according to the invention.

In the formula (I) y of the component A can be a number from 1.3 to 4.

In a preferred form of the invention the crystalline component A can be a zeolite of type A.

The previously mentioned compounds are the essential components of the suspension of the invention. However, there can also be present other components, thus, e.g. foam suppressing additives or so-called solution aids, i.e. compounds which improve the solubility of the added dispersing agent. As foam suppressant there can be added the customary foam suppressing materials, for example foam suppressing soaps, silicone defoamers, foam suppressing triazine derivatives which are collectively known and available to those in the art. This type of additive generally is not necessary; however, with foaming dispersing agents, especially with higher alkylbenzenesulfonic acids, it can be desired to add them.

Also generally there is not needed the addition of a solvent assisting material, but it can be advisable for the suspension of the invention to contain as stabilizing agent a hydrophilic, but slightly water soluble colloid as for example polyvinyl alcohol. Advantageously as, e.g. a solvent aid, it is very suitable to employ dimethyl sulfoxide if the concentration of a stabilizing agent of group 1 having low solubility in water is higher than about 1%. The position of solvent aid in the entire suspension for example can be present for example in the same order of magnitude as the portion of stabilizing agent. Furthermore, there are generally known to those skilled in the art suitable compounds as solvent aids; hydrotropic agents such as for example benzenesulfonic acid, toluenesulfonic acid, xylenesulfonic acid or water soluble salts or even octyl sulfate are suitable.

In the collective data for the "Concentration Of The Aluminum Silicate" to the "Solids Content" or to the content of "Active Substance" (=AS) reference is made to the condition of the aluminum silicate which is reached after drying at 800° C. for one hour. In the drying the adhering and bound water is practically completely removed.

In the aluminum silicates employed of component A it is a question of amorphous or crystalline products whereby of course there can also be employed mixtures of amorphous and crystalline products and also partially crystalline products. The aluminum silicates can be naturally occurring or synthetically produced products, in which case the synthetically produced products are preferred. The production can be carried out, e.g., by reaction of water soluble silicates with water soluble aluminates in the presence of water. For this purpose aqueous solutions of the starting materials can be mixed with each other or one component present in the solid state is reacted with the other as are aqueous solution. Even by mixing both components present in the solid condition there is obtained in the presence of water the desired aluminum silicate. Aluminum silicates can be produced also from $Al(OH)_3$, $Al_2O_3$ or $SiO_2$ by reaction with alkali silicate or aluminate solutions. The production also can be carried out according to further known processes. Especially the invention relates to aluminum silicates which show in three dimensional lattice space structure.

The preferred calcium binding power about in the range of 100 to 200 mg CaO/g AS, for the most part at about 10 to 180 mg CaO/g AS are found above all with compounds of the formula $$0.7\text{–}1.1Na_2O.Al_2O_3.1.3\text{–}3.3SiO_2$$

This summary formula comprehends two types of different crystalline structures (or of the non-crystalline preliminary products), which even differ in their summary formulae. They are:

(a) $0.7\text{–}1.1Na_2O.Al_2O_3.1.3\text{–}2.4SiO_2$ (b) $0.7\text{–}1.1Na_2O.Al_2O_3.2.4\text{–}3.3SiO_2$ The different crystalline structures show up in the X-ray diffraction patterns.

The amorphous or crystalline aluminum silicate present in aqueous suspension can be separated off from the remaining aqueous solution by filtration and dried at a temperature of, e.g. 50° to 400° C. Depending on the drying conditions the product contains more or less bound water.

The higher drying temperatures generally are not recommended; suitably 200° C. is not exceeded if the aluminum silicate is provided for employment in washing agents and detergents (cleansing agents). However, after their production the aluminum silicates in general need not be dried for preparation of a suspension according to the invention, rather there can be used, and this is especially advantageous, an aluminum silicate still wet from the production. However, there also can be used aluminum silicates dried at average temperatures, for example at 80° to 200° C., until the removal of adhering liquid water for the preparation of suspensions according to the invention.

The particle size of the individual aluminum silicate particles can be different and, e.g. be in the range between 0.1μ and 0.1 mm. This data refers to the primary particle size, i.e. the size in the precipitation and in a given case the particles resulting from the subsequent crystallization. With special advantage there are used aluminum silicates which consist of at least 80 weight % of particles having a size of 10 to 0.01μ, especially of 8 to 0.1μ.

Preferably the aluminum silicates no longer contain primary or secondary particles having diameters above 45μ. As secondary particles there are designated the particles which are formed of larger size through the agglomeration of the primary particles.

In regard to the agglomeration of the primary particles to larger structures there has proven especially good for the production of suspensions according to the invention the use of aluminum silicates still wet from their production, since it has proven that in using these still wet products the formation of secondary particles is practically completely stopped.

In a particularly preferred form of the invention there is employed as component A powdery zeolite of Type A with a particularly defined particle spectrum.

This type of zeolite powder can be produced according to one of the following patents and having the particle size distribution curve stated therein.

German OS No. 2447021

German OS No. 2517218 and related Roebke U.S. Pat. No. 4,073,867

German OS No. 2651419 and related Strack U.S. Pat. No. 4,303,628

German OS No. 2651420 and related Strack U.S. Pat. No. 4,303,626

German OS No. 2651436 and related Strack U.S. Pat. No. 4,305,916

German OS No. 2651437 and related Strack U.S. Pat. No. 4,303,627

German OS No. 2651445

German OS No. 2651485 and related Strack U.S. Pat. No. 4,303,629

The entire disclosure of the above-identified published German OS and related United States patents are hereby incorporated by reference and relied upon. There can be used mixtures of zeolites of Type A made according to two or more of the just mentioned German OS and U.S. patents.

Preferably there is employed a zeolite powder of Type A according to German OS No. 2651485 or related Strack U.S. Pat. No. 4,303,629.

The concentration of component A preferably can be 44 to 55 weight %, especially 46 to 52 weight %.

The component B can be a mixture of at least two alkylphenolethoxylates of the formula

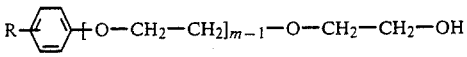

(II)

There the phenol ring can be substituted in either the para or ortho position.

The alkylphenolethoxylates can be employed in any desired mixture, preferably in a ratio of 1:9 to 9:1, more preferably from 2:3 to 3:2, especially 0.9:1.1 to 1.1:0.9. Thereby these alkylphenolethoxylates signify especially compounds of formula (II) in which R is nonyl and m is 5 or 9.

The concentration of this mixture in the aqueous suspension preferably can be from 1 to 2 weight %, especially 1.4 to 1.6 weight %. This concentration is sufficient to stabilize a suspension having a solids content of 50 weight % and more.

The suspension of the invention exhibits the advantage that it is sedimentation stable in the temperature range of 10° to 50° C. and has a pumpable consistency.

Of further advantage is the fact that the alkylphenolethoxylate is liquid at room temperature and therefore need not be heated.

Of particular advantage is the fact that in the suspensions of the invention there can be reached clearly higher solids contents of 50 weight % and above.

The known suspension has a lower sedimentation stability and with the same type of working in its viscosity is too high and therefore is more poorly workable.

Basically the aqueous suspensions besides the mentioned components A and B and besides the, in a given case, starting materials for their production which are still presence can contain other constituents in relatively small amounts. If a further processing of the suspension to washing agents and detergents (cleaning agents) is intended there is a matter of employing additional materials which naturally are suitable for use as components of washing agents and detergents.

A reference point in regard to the stability of the suspension is a simple test in which an aluminum silicate suspension of the desired concentration, e.g. 31%, is produced which contains a dispersing agent according to the invention and in a given case further materials, for example washing agent components such as penta sodium triphosphate, in various amounts. Then the influence of the added materials can be visually observed in the settling behavior of the suspension. After standing for 24 hours a preferred suspension generally should be settled at most to such an extent that the superfluent clear or silicate particle free solution amounts to no more than 20%, preferably not more than 10%, especially not more than 6% of the total height. In general the amount of additive materials is held such that the suspension after standing for 12 hours, or preferably for 24 hours and especially even after 48 hours in supply containers, pipe or hose lines can still be pumped around without problem. The settling behavior of the suspension, in a given case still containing additional components, is tested at room temperature at a total height of the suspension of 10 cm. They are capable of being pumped without problem even after 4 or 8 days. These data for the suspension stability also only give the reference point; it depends on each individual case what suspension stability is established. In using the suspension of the invention as the primary suspension for long time storage in a reservoir from which it can be drawn off by pumping as needed, it can be suitable to maintain as low the portion of other components, for example washing agents and detergents or to entirely eliminate them.

The suspensions can be produced through simple mixing of their components in which case the aluminum silicate, e.g. as such or, in a given case from the production, can be employed in already wet condition or exiting aqueous suspension. It is especially advantageous to stir the components B into the aluminum silicates still wet from their production, e.g. as filter cakes.

Naturally, however, there also can be employed aluminum silicate already dried, i.e. freed from adhering water, in a given case still containing bound water.

The suspensions of the invention are characterized by high stability and other advantages. Their stabilizing effect is especially valuable with aluminum silicates having particle sizes of 5 to 30μ. They are pumpable so that they make possible a simple handling of moist aluminum silicates. Even after long interruptions in the pumping process the suspensions are repumpable without problem. Because of their high stability the suspensions are also transportable in customary tank trucks and tank cars without worrying about the formation of unusable or disturbing residues. Therewith the suspensions are outstandingly suited as a supplier of aluminum silicates for supplying for exmaple producers of washing agents.

The suspensions can be stored at room temperature or even at higher temperatures, pumped through pipe lines or conveyed in other ways. For the most part handling of the suspension is carried out at temperatures between room temperature, the most preferred, and about 50° C.

The suspensions of the invention are especially suited for the further processing to dry appearing, flowable or pourable products, thus for example for the production of powdery, water dehardening agents, e.g., by spray drying. Therewith the suspensions are of considerable importance in the production of powdery aluminum silicates. There do not occur any troublesome residues in supplying the aqueous suspensions to the drying apparatus. Furthermore it has been found that the suspensions of the invention make possible processing to extraordinarily dust free products.

Because of their particular stability the suspensions of the invention are usable as such, i.e. without further processing, with or without additional washing, bleaching and/or cleansing additives, for example as water dehardening agents, washing agents or detergents and especially as liquid scouring agents having increased suspension stability.

A particularly important use of the suspension is the further processing to dry appearing, pourable or flowable washing agents or detergents which contain additional compounds besides the components of the suspension.

The suspensions of the invention are particularly suited for the production of powdery washing agents and detergents (cleansing agents).

For the production of this agent there is started with an aqueous, flowable preliminary mixture of the individual components of the agent this is converted in the customary manner into a pourable product. Thereby the above defined aluminum silicate is employed in the form of the suspension of the invention. The suspensions of the invention can be worked according to any known process to form the solid, pourable washing agent and detergent.

Particularly there is started with in the production of powdery, pourable washing agents and detergents a suspension according to the invention, for example from a supply container, is mixed with at least one washing, bleaching or cleansingly active components of the agent being produced and the mixture subsequently converted into the powdery product according to any desired process. Advantageously a complex former is added, i.e. a compound which can bind into complexes the alkaline earth metal ions, especially magnesium and calcium ions responsible for water hardness.

Generally in the production of washing agents and cleansing agents (detergents) the suspension of the invention is preferably combined with at least one water soluble tenside not belonging to the possible constituents of component B. Illustrative of such tensides are alkali metal alkylbenzenesulfonates, e.g. sodium dodecylbenzenesulfonate.

There are different variants possible in the production of washing agents and detergents.

For example the suspensions of the invention can be combined with materials capable of binding water of crystallization, suitably by spraying the suspension on the compounds capable of binding water of crystallization as the compounds are present in a mixer so that with continuous thorough mixing there is obtained a fine solid, dry appearing product. Preferably, however, the suspensions of the invention are mixed as a "slurry" with at least one additional, washing, or cleansing compound and subjected to atomizing drying. Thereby there is shown a further unexpected advantage of the claimed aluminum silicate suspension. Namely it has been shown that with inclusion of the suspensions of the invention there can be obtained very low dust products in the atomizing drying. The products obtained by atomizing drying show a high calcium binding power and have good wettability.

Washing agents which are produced using the above described suspensions can be composed in different ways. Generally they contain at least one dispersing agent belonging to the water soluble tensides not employed in the invention which is present in the claimed aluminum silicate suspension. Besides they generally contain at least one additional compound which has a washing, bleaching or cleansing action and is either inorganic or organic, an aluminum silicate as above defined as calcium binding compound. Furthermore there can be present in these types of agents other customarily present assistants and additives, for the most part in small amounts. Thus there can be used the additives shown in German OS No. 2615698, the entire disclosure of which is hereby incorporated by reference and relied upon.

Unless otherwise indicated, all parts and percentages are by weight.

The process can comprise, consist essentially of, or consist of the stated steps with the recited materials and the compositions can comprise, consist essentially of, or consist of the stated materials.

EXAMPLES

There was stirred a zeolite A-filter cake with water and stabilizer.

As stabilizer there were used compounds according to formula (II) whereby m is 5.9 and 10 and R is nonyl. The degree of ethoxylation EO is stated.

In all cases there was used a zeolite of type A (filter cake) which was produced according to German OS No. 2651485 (and related Strack U.S. Pat. No. 4,303,629) and had the particle spectrum stated there.

| | 1 | 2 | 3 | 4 | 5 | 6 |
|---|---|---|---|---|---|---|
| Size of preparation | 200 g | 200 g | 200 g | 200 g | 200 g | 200 g |
| Stabilizer | EO 5 | EO 9 | EO 5/ EO 9 | EO 5/ EO 9 | EO 5/ EO 9 | EO 10 |
| Concentration | 1.5% | 1.5% | 1.5% | 1.5% | 1.5% | 1.5% |
| Mixing ratio | —/— | —/— | 1:1 | 3:7 | 6:4 | 1:1 |
| Type of working in | Dissolver/wing disc | | | | | |
| Duration of working in | 5' | 5' | 5' | 5' | 5' | 5' |
| Stirring speed | 1000 R/min | 1000 R/min | 1000 R/min | 1000 R/min | 1000 R/min | 1000 R/min |
| Storage temperature | 22/45° C. | 22/45° C. | 22/45° C. | 22/45° C. | 22/45° C. | 22/45° C. |
| Standing time | 3 Days | 3 Days | 3 Days | 3 Days | 3 Days | 3 Days |
| Clear Phase | 1 mm/— | 2 mm/— | —/— | —/— | 1 mm/— | —/— |
| Homogeneity | 4 | 4 | 2/1 | 2/4 | 4 | 1 |
| Flow behavior | 2 | 2/3 | 1 | 2/4 | 4 | 2 |
| Sediment | 1 mm | —/— | —/— | —/— | 1 mm/— | —/— |
| Solids Concentration | 49.4% | 49.4% | 49.4% | 47.6% | 47.6% | 47.6% |

Evaluation of homogeneity and flow behavior was carried out according to the school note system after the storage time. The viscosity was measured when fresh, but it did not change during the storage time with homogeneous samples.

| | 7 | 8 | 9 | 10 | 11 | 12 | 13 | 14 | 15 | 16 |
|---|---|---|---|---|---|---|---|---|---|---|
| Size of preparation | 200 g | 200 g | 2 kg | 2 kg | 2 kg | 2 kg | 2 kg | 50 kg | 50 kg | 200 kg |
| Stabilizer | EO 6/ EO 9 | EO 6/ EO 10 | EO 5/ EO 9 | EO 5/ EO 9 | EO 5/ EO 9 | EO 5/ EO 9 | EO 5/EO 9 | EO 5/EO 9 | EO 5/EO 9 | EO 5/EO 8 |

-continued

| | | | | | | | | | | |
|---|---|---|---|---|---|---|---|---|---|---|
| Concentration | 1.5% | 1.5% | 1.5% | 1.3% | 1.1% | 1.5% | 1.5% | 1.5% | 1.5% | 1.5% |
| Mixing ratio | 1:1 | 1:1 | 1:1 | 1:1 | 1:1 | 1:1 | 1:1 | 1:1 | 1:1 | 1:1 |
| Type of working in | Dissolver wing disc | | MIG-stirrer | MIG-stirrer | MIG-stirrer | MIG-stirrer | MIG-stirrer | MIG-stirrer | Dissolver/ wing stirrer | |
| Duration of working in | 5' | 5' | 10' | 10' | 10' | 10' | 10' | 10' | 10' | 5' |
| Stirring speed | 1000 R/min | 1000 R/min | 200 R/min | 200 R/min | 200 R/min | 200 R/min | 200 R/min | 76 R/min | 200 R/min | 1000 R/min |
| Storage temperature | 22/45° C. | 22/45° C. | 22/45° C. | 22/45° C. | 22/45° C. | 22/45° C. | 22° C. | 22° C. | −5 bis+ 10° C. | 22/45° C. |
| Standing time | 3 Days | 3 Days | 3 Days | 3 Days | 3 Days | 3 Days | 30 Days | 35 Days | 20 Days | 3 Days |
| Clear Phase | 1 mm | 1 mm/— | —/— | 1 mm | 1 mm | 1 mm | 1 mm | 2 mm | 5 mm | —/— |
| Homogeneity | 2 | 4 | 1 | 1 | 1 | 1 | 1 | 2 | 3 | 2 |
| Flow behavior | 2 | 2/4 | 1 | 2 | 2 | 1 | 1 | 2 | 2 | 2 |
| Sediment | —/— | 1 mm/— | —/— | —/— | 1 mm | —/— | —/— | 3 mm | 10 mm | —/— |
| Solids Concentration | 47.6% | 47.6% | 43.6% | 44% | 44% | 44% | 43.6% | 43.6% | 43.6% | 47.6% |
| Viscosity | — | — | 295 m.Pas | 145 m.Pas | 116 m.Pas | 375 m.Pas | — | 163 m.Pas | 13.5 m.Pas | — |

| | 17 | 18 | 19 | 20 | 21 | 22 | 23 | 24 | 25 |
|---|---|---|---|---|---|---|---|---|---|
| Size of preparation | 200 g | 200 g | 200 g | 200 g | 200 g | 200 g | 50 kg | 50 kg | 50 kg |
| Stabilizer | EO 5/ EO 9 | EO 5/ EO 9 | EO 6 | EO 7 | EO 5/ EO 9 | EO 5/ EO 9 | EO 5/EO 9 | EO 5/EO 9 | EO 5/EO 9 |
| Concentration | 1.5% | 1.5% | 1.5% | 1.5% | 1.5% | 1.5% | 1.5% | 1.5% | 1.5% |
| Mixing ratio | 4:6 | 7:3 | — | — | 4:6 | 7:3 | 1:1 | 1:1 | 1:1 |
| Type of working in | | | Dissolver/wing disc | | | | MIG-stirrer | MIG-stirrer | MIG-stirrer |
| Duration of working in | 5' | 5' | 5' | 5' | 5' | 5' | 10' | 10' | 10' |
| Stirring speed | 1000 R/min | 1000 R/min | 1000 R/min | 1000 R/min | 1000 R/min | 1000 R/min | 200 R/min | 200 R/min | 200 R/min |
| Storage temperature | 22/45° C. | 22/45° C. | 22/45° C. | 22/45° C. | 22/45° C. | 22/45° C. | 22° C. | 15° C. | 10° C. |
| Standing time | 3 Days | 3 Days | 3 Days | 3 Days | 3 Days | 3 Days | 3 Days | 3 Days | 3 Days |
| Clear Phase | —/— | 1 mm/3 mm | 1 mm/4 mm | 1 mm/— | 1 mm/— | —/— | — | — | — |
| Homogeneity | 4/2 | 4 | 4/4 | 4/2 | 4/4 | 3/4 | 1 | 1 | 1 |
| Flow behavior | 4/2 | 4 | 4/2 | 3/2 | 4/4 | 3/4 | 1 | 1 | 1 |
| Sediment | —/— | —/— | 3 mm/3 mm | —/— | 1 mm/— | —/— | — | — | — |
| Solids Concentration | 47.6% | 47.6% | 47.6% | 49.4% | 47.6% | 47.6% | 50.0% | 50.0% | 50.0% |
| Viscosity | — | — | — | — | — | — | 288 m.Pas | 766 m.Pas | 1688 m.Pas |

In the following examples 26 to 37 there were used compounds of formula (II) wherein n is 5.9, 7 and 12 and R is nonyl and octyl.

The zeolite A employed is identical with that given in examples 1 to 25.

| | 26 | 27 | 28 | 29 | 30 | 31 |
|---|---|---|---|---|---|---|
| Size of preparation | 200 g | 200 g | 200 g | 200 g | 200 g | 200 g |
| Stabilizer | Octylphenol-ethoxylate EO 5/Octylphenol-ethoxylate EO 9 | Octylphenol-ethoxylate/ Nonylphenol-ethoxylate EO 9/ Octylphenoleth-oxylate/Nonyl-phenolethoxy-late EO5 | Octylphenol-ethoxylate EO 5/Octyl-phenoletho-xylate/Nonyl-phenolethoxy-late EO 9 | Octylphenol-ethoxylate EO 9/Nonylphenol-ethoxylate/ Octylphenol-ethoxylate EO 5 | Octylphenol-ethoxylate EO 5/Nonylphenol-ethoxylate EO 9 | Nonylphenol-ethoxylate EO 5 Octylphenol-ethoxylate EO 9 |
| Concentration | 1.5% | 1.5% | 1.5% | 1.5% | 1.5% | 1.5% |
| Mixing ratio | 1:1 | 1:1 | 1:1 | 1:1 | 1:1 | 1:1 |
| Type of working in | Dissolver/wing disc | | | Dissolver/wing disc | | |
| Duration of working in | 5' | 5' | 5' | 5' | 5' | 5' |
| Stirring speed | 1000 R/min | 1000 R/min | 1000 R/min | 1000 R/min | 1000 R/min | 1000 R/min |
| Storage temperature | 22/45° C. | 22/45° C. | 22/45° C. | 22/45° C. | 22/45° C. | 22/45° C. |
| Standing time | 3 Days | 3 Days | 3 Days | 3 Days | 3 Days | 3 Days |
| Clear Phase | 1 mm/1 mm | —/1 mm | —/— | —/— | —/— | —/— |
| Homogeneity | 4/2 | 2/2 | 3/3 | 3/3 | 2/3 | 2/3 |
| Flow behavior | 2/2 | 2/2 | 3/3 | 2/2 | 2/2 | 2/2 |
| Sediment | 1 mm/— | —/1 mm | —/— | —/— | —/— | —/— |
| Solids Concentration | 50.5% | 50.5% | 50.5% | 50.5% | 50.5% | 50.5% |

| | 32 | 33 | 34 | 35 | 36 | 37 |
|---|---|---|---|---|---|---|
| Size of preparation | 200 g | 200 g | 200 g | 200 g | 200 g | 200 g |
| Stabilizer | Octylphenol-ethoxylate Nonylphenol-ethoxylate EO 5/Nonyl-phenoletho-xylate EO 9 | Octylphenol-ethoxylate Nonylphenol-ethoxylate EO 9/Nonyl-phenoletho-xylate EO 5 | Octylphenol-ethoxylate EO 5/Nonyl-phenoleth-oxylate EO 5 | Octylphenol-ethoxylate EO 9/Nonyl-phenolethoxy-late EO 9 | Octylphenol-ethoxylate EO 7 Nonylphe-nolethoxylate EO 7 | Octylphenol-ethoxylate EO 12/Nonyl-phenolethoxy-late EO 12 |
| Concentration | 1.5% | 1.5% | 1.5% | 1.5% | 1.5% | 1.5% |

-continued

| | | | | | | |
|---|---|---|---|---|---|---|
| Mixing ratio | 1:1 | 1:1 | 1:1 | 1:1 | 1:1 | 1:1 |
| Type of working in | Dissolver/wing disc | | | Dissolver/wing disc | | |
| Duration of working in | 5' | 5' | 5' | 5' | 5' | 5' |
| Stirring speed | 1000 R/min | 100 R/min | 1000 R/min | 1000 R/min | 1000 R/min | 1000 R/min |
| Storage temperature | 22/45° C. | 22/45° C. | 22/45° C. | 22/45° C. | 22/45° C. | 22/45° C. |
| Standing time | 3 Days | 3 Days | 3 Days | 3 Days | 3 Days | 3 Days |
| Clear Phase | —/— | —/— | 1 mm/2 mm | 2 mm/— | 1 mm/1 mm | —/1 mm |
| Homogeneity | 2/2 | 2/2 | 5/5 | 5/2 | 5/5 | 5/4 |
| Flow behavior | 2/2 | 2/2 | 4/5 | 5/2 | 5/5 | 3/3 |
| Sediment | —/— | —/— | —/5 mm | —/— | 2 mm/— | —/— |
| Solids Concentration | 50.5% | 50.5% | 50.5% | 50.5% | 50.5% | 50.5% |

Evaluation of homogeneity and flow behavior was carried out according to the school note system after the storage time. The viscosity was measured when fresh, but it did not change during the storage time with homogeneous samples.

The entire disclosure of German priority application P 3209631.3 is hereby incorporated by reference.

What is claimed is:

1. An aqueous pumpable stable suspension of a water insoluble silicate capable of binding calcium ions which contains, based on the total weight of the aqueous suspension (A) as the silicate capable of binding calcium 0.5 to 80 weight percent of a finely divided, crystalline, bound water containing, synthetically produced water insoluble zeolite A of the formula $$(Cat_{2/n}O)_x.Al_2O_3.(SiO_2)_y \quad (I)$$

in which Cat is a cation exchangeable with calcium and which has the valence n, x is a number from 0.7 to 1.5, y is a number between 1.3 and 4, and (B) as a dispersingly active component 0.5 to 6 weight percent of a mixture of two different alkylphenolethoxylates of the formula

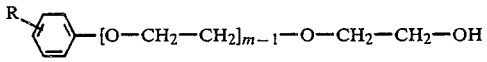

$$R-C_6H_4-[O-CH_2-CH_2]_{m-1}-O-CH_2-CH_2-OH \quad (II)$$

where R is an alkyl group of 1 to 5 carbon atoms, wherein the ratio of the two alkylphenolethoxylates is from 1:9 to 9:1 and wherein in one of the alkylphenolethoxylates m is 2 to 7 and in the other m is 8 to 15.

2. A suspension according to claim 1 wherein the ratio of the two alkylphenolethoxylates is from 2:3 to 3:2.

3. A suspension according to claim 2 wherein the ratio of the two alkylphenolethoxylates is from 0.9:1.1 to 1.1:0.9.

4. A suspension according to claim 3 wherein Cat is sodium.

5. A suspension according to claim 2 wherein R is nonyl.

6. A suspension according to claim 5 wherein Cat is sodium.

7. A suspension according to claim 2 wherein one m is 5 and the other m is 9 or 10.

8. A suspension according to claim 7 wherein Cat is sodium.

9. A composition according to claim 2 wherein the concentration of A is 44 to 55% and the concentration of B is 1 to 2%.

10. A suspension according to claim 9 wherein Cat is sodium.

11. A composition according to claim 2 wherein the concentration of A is 46 to 52% and the concentration of B is 1.4 to 1.6%.

12. A suspension according to claim 11 wherein Cat is sodium.

13. A composition according to claim 2 wherein at least 80% of the particles of component A have a size of 10 to 0.01$\mu$.

14. A composition according to claim 2 wherein at least 80% of the particles of component A have a size of 8 to 0.1$\mu$.

15. A suspension according to claim 14 wherein Cat is sodium.

16. A suspension according to claim 2 wherein Cat is sodium.

17. A suspension according to claim 1 wherein R is nonyl.

18. A suspension according to claim 1 wherein one m is 5 and the other m is 9 or 10.

19. A composition according to claim 1 wherein the concentration of A is 44 to 55% and the concentration of B is 1 to 2%.

20. A suspension according to claim 1 wherein Cat is sodium.

21. A suspension according to claim 1 consisting essentially of water, the zeolite A, and the two alkylphenolethoxylates.

22. A composition according to claim 1 consisting of water, the zeolite A, and the two alkylphenoethoxylates.

* * * * *